US007395800B2

(12) United States Patent
Matsuda et al.

(10) Patent No.: US 7,395,800 B2
(45) Date of Patent: Jul. 8, 2008

(54) FOUR-CYCLE ENGINE AND MOTORCYCLE COMPRISING FOUR-CYCLE ENGINE

(75) Inventors: Yoshimoto Matsuda, Kobe (JP); Seiji Azuma, Akashi (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 0 days.

(21) Appl. No.: 11/592,721

(22) Filed: Nov. 3, 2006

(65) Prior Publication Data

US 2007/0107688 A1 May 17, 2007

(30) Foreign Application Priority Data

Nov. 10, 2005 (JP) ..... 2005-325650

(51) Int. Cl.
*F02B 75/06* (2006.01)

(52) U.S. Cl. ..... 123/195 R; 123/192.2

(58) Field of Classification Search ..... 123/195 R, 123/572, 41.86, 192.2
See application file for complete search history.

(56) References Cited

U.S. PATENT DOCUMENTS 4,541,399 A * 9/1985 Tanaka et al. ..... 123/573
4,656,991 A * 4/1987 Fukuo et al. ..... 123/572
4,696,267 A * 9/1987 Kohno et al. ..... 123/192.2
4,790,287 A * 12/1988 Sakurai et al. ..... 123/573
6,425,451 B2 * 7/2002 Yoshida et al. ..... 180/219

FOREIGN PATENT DOCUMENTS

JP 57-193708 11/1982

* cited by examiner

*Primary Examiner*—Stephen K. Cronin
*Assistant Examiner*—Hyder Ali
(74) *Attorney, Agent, or Firm*—Alleman Hall McCoy Russell & Tuttle LLP

(57) ABSTRACT

A four-cycle engine of the present invention comprises a gas exhaust outlet that is formed on an upper region of a crankcase to exhaust a gas from the interior of the crankcase to outside; and a rotatable shaft disposed in close proximity to the gas exhaust outlet in the interior of the crankcase. The gas exhaust outlet is configured to open toward a region in the interior of the crankcase, the region extending from a line segment connecting the gas exhaust outlet to a rotational center axis of the shaft, in a rotational direction of the shaft at a cross point where the line segment crosses an outer peripheral surface of the shaft.

6 Claims, 6 Drawing Sheets

FOUR-CYCLE ENGINE AND MOTORCYCLE COMPRISING FOUR-CYCLE ENGINE

BACKGROUND OF THE INVENTION

1. Field of the Invention

The present invention relates to a four-cycle engine and a motorcycle comprising the four-cycle engine. More particularly, the present invention relates to a construction that enables efficient separation of a blow-by gas from oil.

2. Description of the Related Art

For example, in four-cycle engines mounted in motorcycles, a blow-by gas in some cases flows from a combustion chamber into a crankcase through a gap between a piston and an inner wall of a cylinder block. An internal pressure of the crankcase rises because of the presence of the blow-by gas, and becomes resistance to downward movement of the piston. This undesirably increases a pumping loss and reduces an output in a high-output and high-speed engine. Accordingly, in order to lower the internal pressure of the crankcase, the crankcase is conventionally provided with a gas exhaust outlet to exhaust the blow-by gas to the outside of the crankcase (e.g., Publication of Japanese Examined Patent Application No. Hei. 1-16323).

In general, in four-cycle engines, oil is fed to a journal portion of the crankshaft for lubrication to enable the journal portion and a mounting wall portion mounting the journal portion to smoothly slide relative to each other. Further, the oil is injected to a back surface of the piston to cool the piston. Since the oil fed to these components scatters toward a surrounding region, a gas-oil mixture of the blow-by gas and oil mist is filled in the crankcase. Therefore, if the blow-by gas is exhausted from the interior of the crankcase in order to lower the internal pressure of the crankcase, the oil mist is undesirably exhausted together with the blow-by gas.

In a crankcase that accommodates a transmission along with the crankshaft, a primary gear with a relatively large diameter is mounted on an input shaft end of the transmission, and a gas exhaust outlet is provided at a location (side wall portion of the crankcase) opposite to a side surface of the primary gear. In such a construction, since the primary gear covers a region near the gas exhaust outlet, it is possible to inhibit the oil from mixing into the blow-by gas exhausted from the gas exhaust outlet. Furthermore, in order to remove some oil contained in the blow-by gas exhausted from the gas exhaust outlet, it is known that the gas-oil mixture is guided to a gas-liquid separating chamber to separate the blow-by gas from the oil.

However, in engines having a limited width, such as a four-cycle engine mounted in a motorcycle, it is difficult to provide the gas-liquid separating chamber laterally of the crankcase. So, in many cases, the gas-liquid separating chamber must be located in an extra space distant from the gas exhaust outlet provided on the side wall portion of the crankcase. In these cases, an elongate gas passage is formed in the side wall portion of the crankcase by using a gun drill, or a hole is formed to penetrate the side wall portion of the crankcase to form a gas exhaust outlet, and a gas pipe extends from an outer opening of the gas exhaust outlet of the side wall portion so that the blow-by gas is guided to the gas-liquid separating chamber.

SUMMARY OF THE INVENTION

In view of the foregoing, an object of the present invention is to provide a four-cycle engine that is capable of suppressing entry of oil into a blow-by gas exhausted from a crankcase and of easily guiding the blow-by gas exhausted from a gas exhaust outlet to a gas-liquid separating chamber, and a motorcycle comprising the four-cycle engine.

The present invention has been made under these circumstances, and a four-cycle engine of the present invention comprises a gas exhaust outlet that is formed on an upper region of a crankcase to exhaust a gas from an interior of the crankcase to outside; and a rotatable shaft disposed in close proximity to the gas exhaust outlet in the interior of the crankcase; wherein the gas exhaust outlet is configured to open toward a region in the interior of the crankcase, the region extending from a line segment connecting the gas exhaust outlet to a rotational center axis of the shaft, in a rotational direction of the shaft at a cross point where the line segment crosses an outer peripheral surface of the shaft.

In such a construction, it is possible to suppress entry of the oil scattering from the shaft rotating within the crankcase into the gas exhaust outlet together with the blow-by gas. To be specific, a large part of the oil filled in the crankcase scatters from the outer peripheral surface of the shaft according to the rotation of the shaft within the crankcase. The oil scatters from the outer peripheral surface of the shaft in the rotational direction along a tangential direction. In contrast, as viewed along the center axis of the shaft, the gas exhaust outlet of the present invention opens toward a rightward region relative to the line segment connecting the gas exhaust outlet to the rotational center axis of the shaft when the shaft rotates clockwise, whereas the gas exhaust outlet opens toward a leftward region relative to the line segment when the shaft rotates counterclockwise. In this case, the oil is likely to scatter from the rotating shaft in the direction away from the gas exhaust outlet or to approach the gas exhaust outlet from laterally. That is, the oil does not scatter toward the gas exhaust outlet from the front. As a result, entry of the oil into the gas exhaust outlet can be effectively suppressed.

In the motorcycle, an extra space in which the gas-liquid separating chamber can be mounted is easily ensured above the crankcase. Therefore, by forming the gas exhaust outlet on the upper region of the crankcase as described above, the gas-liquid separating chamber provided above the crankcase can easily communicate with the gas exhaust outlet.

The shaft may be a balancer shaft configured to support a balancer weight, and the gas exhaust outlet may be disposed above the balancer shaft. A scattering distance of the oil scattering from the surface of a rotatable element becomes shorter when a rotation radius of the rotatable element is smaller because an initial speed of the oil coming off from the surface is lower. Therefore, by disposing the gas exhaust outlet above the balancer shaft with a diameter smaller than that of the balancer weight, it is possible to suppress scattering of the oil to a region near the gas exhaust outlet.

The crankcase may have a mounting portion configured to rotatably mount the crankshaft, and the mounting portion may have a block portion formed to cross a line segment connecting the gas exhaust outlet to a rotational center axis of the crankshaft and perpendicular to the rotational center axis of the crankshaft. In such a construction, the block portion blocks the oil scattering from the outer peripheral surface of the crankshaft to suppress the entry of the oil into the gas exhaust outlet.

The four-cycle engine may further comprise the gas-liquid separating chamber mounted at the upper region of the crankcase to allow a gas from the gas exhaust outlet to flow thereinto. In such a construction, a space above the crankcase which is relatively easily to obtain can be utilized, and the gas-liquid separating chamber and the gas exhaust outlet can be connected to each other easily to have a short distance therebetween.

A motorcycle of the present invention comprises the four-cycle engine according any one of the above described constructions. In such a construction, it is possible to efficiently suppress entry of the oil into the blow-by gas exhausted from the crankcase and to easily guide the blow-by gas exhausted from the gas exhaust outlet to the gas-liquid separating chamber in the case where the gas-liquid separating chamber is provided above the crankcase.

DETAILED DESCRIPTION OF THE PREFERRED EMBODIMENTS

Hereinafter, a four-cycle engine according to the present invention and a motorcycle comprising the four-cycle engine will be described in detail with reference to the drawings. In this embodiment, the direction "forward" means the direction in which the motorcycle is traveling, and other directions mean directions from the perspective of a rider mounting the motorcycle using forward as a reference, except for where specifically illustrated.

Figure 1:
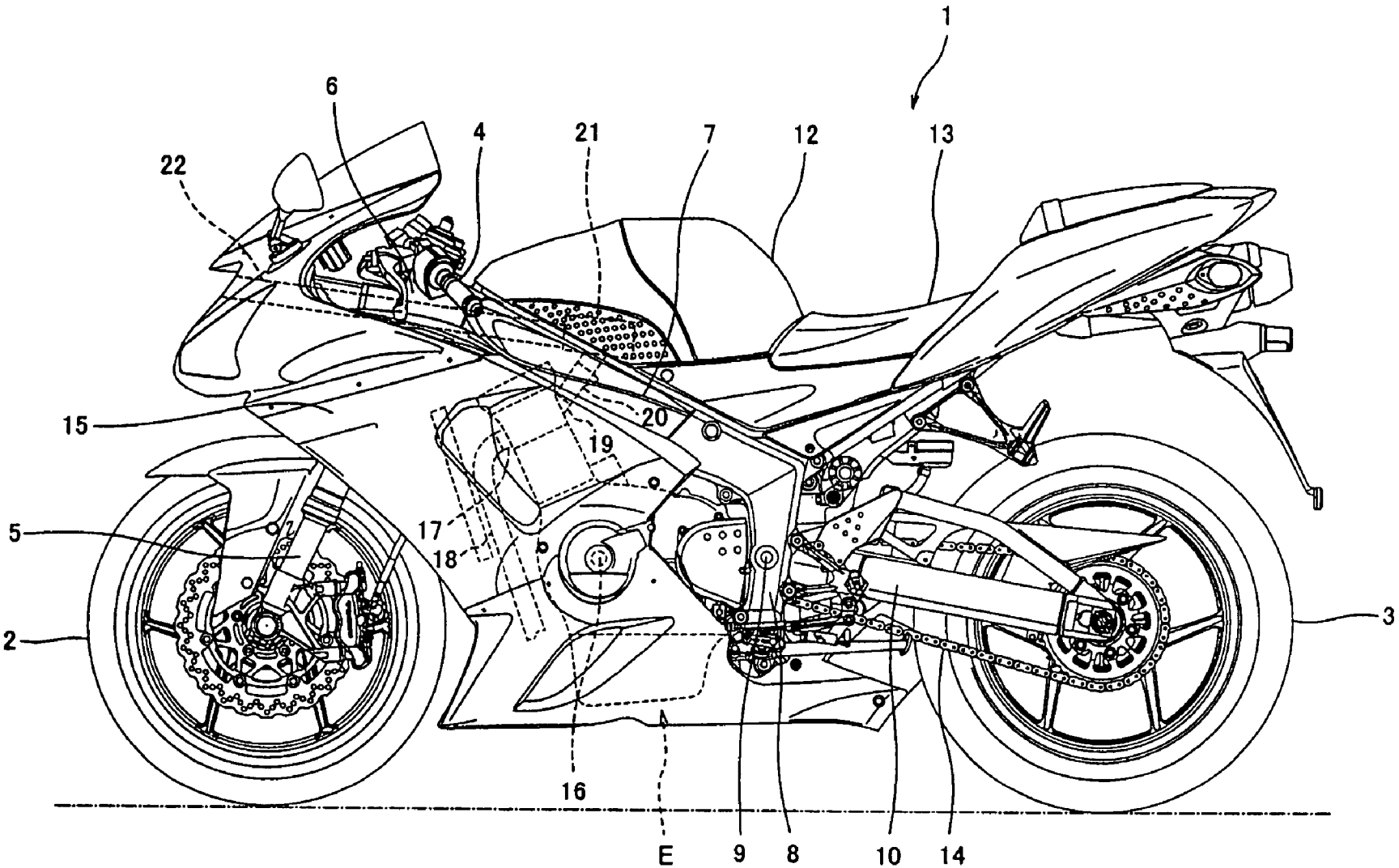
FIG. 1 is a left side view of a motorcycle according to an embodiment of the present invention.

FIG. 1 is a left side view of a motorcycle 1 according to an embodiment of the present invention. As shown in FIG. 1, the motorcycle 1 is of a road sport type and includes a front wheel 2 and a rear wheel 3. The front wheel 2 is rotatably mounted to a lower end portion of a front fork 5 extending vertically. The front fork 5 is mounted on a steering shaft (not shown) by an upper bracket (not shown) attached to an upper end thereof, and an under bracket located below the upper bracket. The steering shaft is rotatably supported by a head pipe 6. A bar-type steering handle 4 extending rightward and leftward is attached to the upper bracket. When the rider rotates the steering handle 4 clockwise or counterclockwise, the front wheel 2 is turned to a desired direction around the steering shaft.

The frame of the motorcycle 1 is of a so-called twin tube type. A pair of right and left main frames 7 (only left main frame 7 is illustrated in FIG. 1) extend rearward from the head pipe 6. Pivot frames (swing arm brackets) 8 extend downward from rear regions of the main frames 7. A swing arm 10 is pivotally mounted at a front end portion thereof to a pivot 9 attached on the pivot frame 8. The rear wheel 3 is rotatably mounted to a rear end portion of the swing arm 10.

A fuel tank 12 is disposed above the main frames 7 and behind the steering handle 4. A straddle-type seat 13 is disposed behind the fuel tank 12. A four-cycle engine (hereinafter simply referred to as an engine) E indicated by a broken line of FIG. 1 is mounted between and under the right and left main frames 7. The engine E is covered with a cowling 15 from the side to forward of the steering shaft (not shown). The engine E is an inline four-cylinder engine, and is constructed in such a manner that a crankshaft 16 extends substantially in a rightward and leftward direction of a vehicle body. An output of the engine E is transmitted, through a chain 14, to the rear wheel 3, which thereby rotates. In this manner, the motorcycle 1 obtains a driving force.

An exhaust pipe 18 is coupled to an exhaust port 17 of the engine E to extend rearward from forward of the engine E through a region thereunder. A downstream end portion of a throttle device 20 is coupled to an intake port 19 of the engine E. An air cleaner box 21 disposed between the right and left frames 7 is coupled to an upstream end portion of the throttle device 20. An air-intake duct 22 extends forward from the air cleaner box 21. An upstream end of the air-intake duct 22 opens at a front portion of the cowling 15. The engine E is configured to take in air from outside using running wind (ram pressure).

Figure 2:
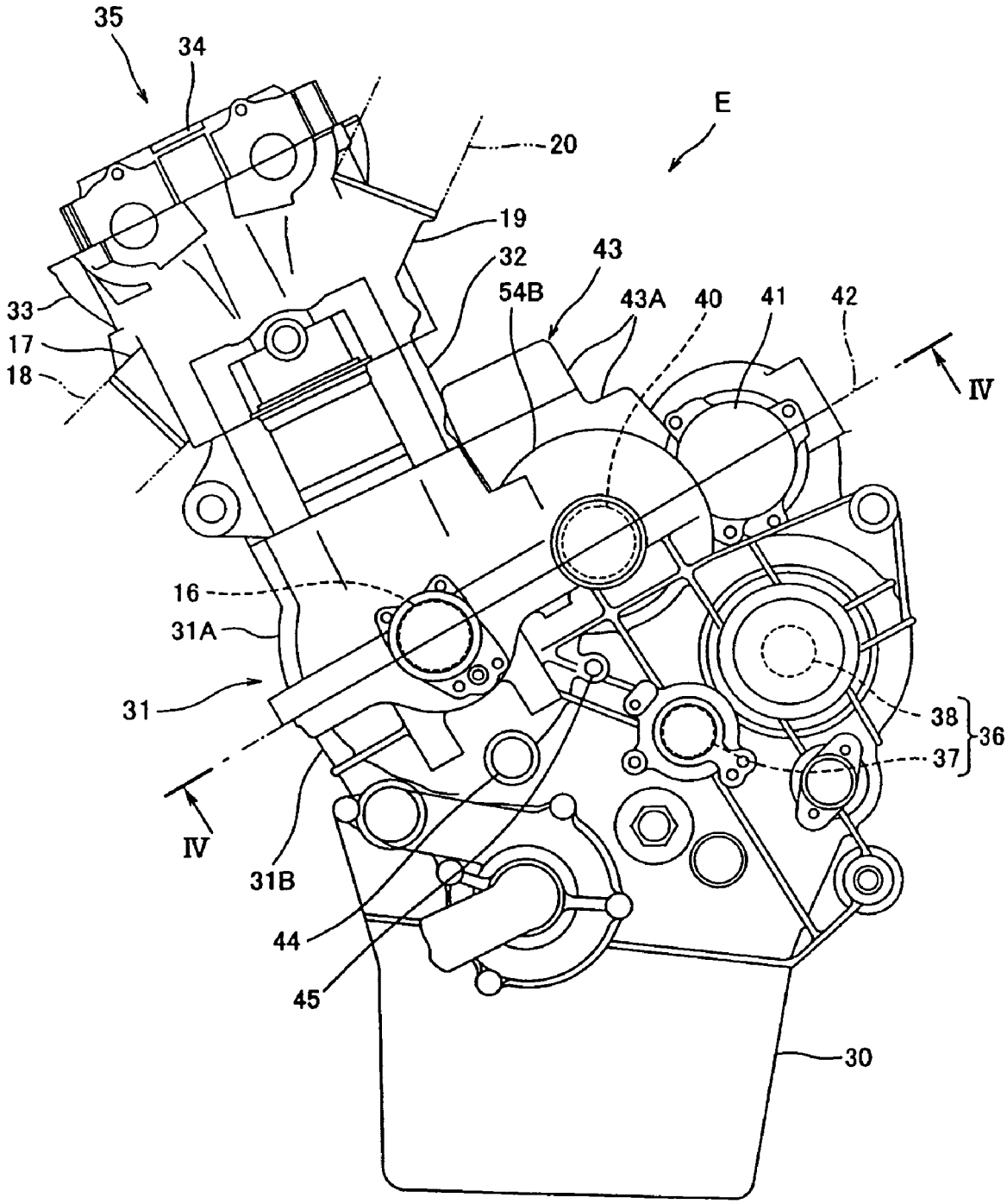
FIG. 2 is a left side view of an engine of the motorcycle of FIG. 1.

FIG. 2 is a left side view showing the engine E of the motorcycle 1 shown in FIG. 1. The engine E includes an oil pan 30, a crankcase 31, a cylinder block 32, a cylinder head 33, and a cylinder head cover 34 arranged in this order from below. A cylinder 35 is composed of the cylinder block 32, the cylinder head 33, and the cylinder head cover 34 and is tilted forward with respect to a vertical direction of the vehicle body of the motorcycle 1. A crankshaft 16, a main shaft 37 and a counter shaft 38 forming a transmission 36, gears (not shown), etc are accommodated in the interior of the crankcase 31.

The crankshaft 16 is mounted such that its center axis is oriented in the rightward and leftward direction as described above. The main shaft 37 is located behind the crankshaft 16 and extends substantially in parallel with the crankshaft 16. The countershaft 38 is mounted behind and obliquely above the main shaft 37 and extends substantially in parallel with the main shaft 37. A clutch (not shown) is mounted on one end of the main shaft 37. With the clutch in an on-state, a rotational force of the crankshaft 16 is transmitted to the main shaft 37. The speed of the rotational force of the main shaft 37 is reduced in a predetermined gear ratio and transmitted to the counter shaft 38. The rotational force is output from the countershaft 38 to the chain 14 shown in FIG. 1.

A balancer shaft 40 is disposed behind and obliquely above the crankshaft 16 and is configured to be rotatable in association with the crankshaft 16. A generator 41 for electric power generation is disposed behind and obliquely above the balancer shaft 40. The crankshaft 16, the balancer shaft 40, and the generator 41 are disposed in such a manner their center axes are located on a plane 42. The crankcase 31 is divided into an upper crankcase 31A and a lower crankcase 31B at the plane (parting plane) 42.

An extra space is formed above the crankcase 31, below the air-intake port 19, and behind the cylinder block 32. A breather 43 is disposed in the space. The breather 43 is separable from the crankcase 31, and is fastened from above to an upper surface of an upper side wall portion 54B of the crankcase 31 by bolts. A casing 43A of the breather 43 is divided into upper and lower parts. A gas-liquid separating chamber 43B (see FIG. 3) having a labyrinth structure is formed within the casing 43A. The breather 43 may be integral with the crankcase 31.

A main gallery 44 extends below and substantially in parallel with the crankshaft 16 in the interior of the crankcase 31 and is configured to flow oil suctioned up from the oil pan 30. A sub-gallery 45 extends behind, obliquely above and substantially in parallel with the main gallery 44. The main gallery 44 mainly delivers the oil to regions such as crank journals 61A to 61C and crankpins 60A to 60D at which the crankshaft 16 is configured to contact bearing portions 52A to 52C (see FIG. 4), connecting rods and the like, or back surfaces of pistons (not shown). The sub-gallery 45 delivers the oil to the cylinder head 33 to mainly lubricate a valve system.

Figure 3:
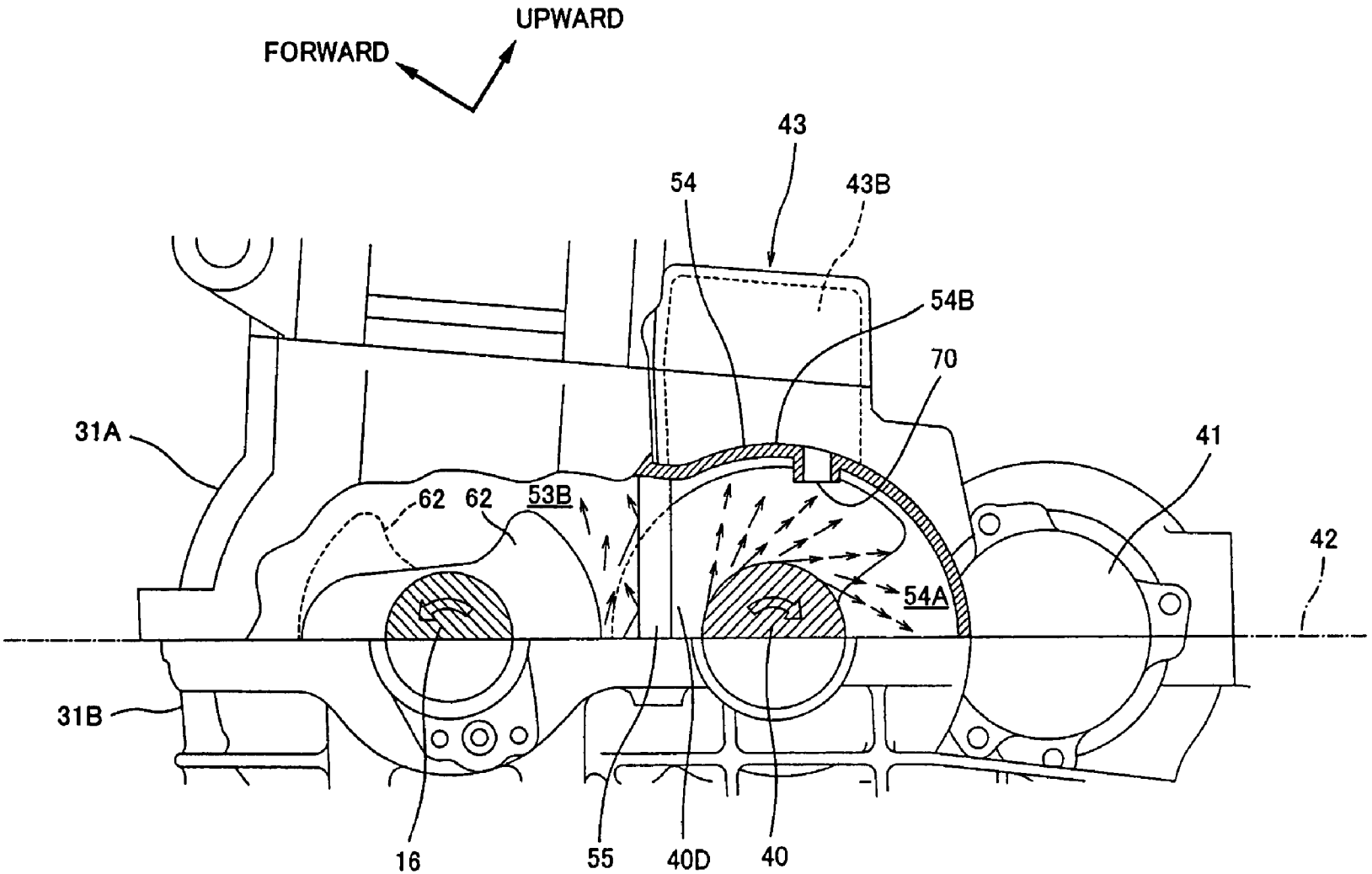
FIG. 3 is an enlarged partial cross-sectional view of a crankcase of the engine of FIG. 2.
Figure 4:
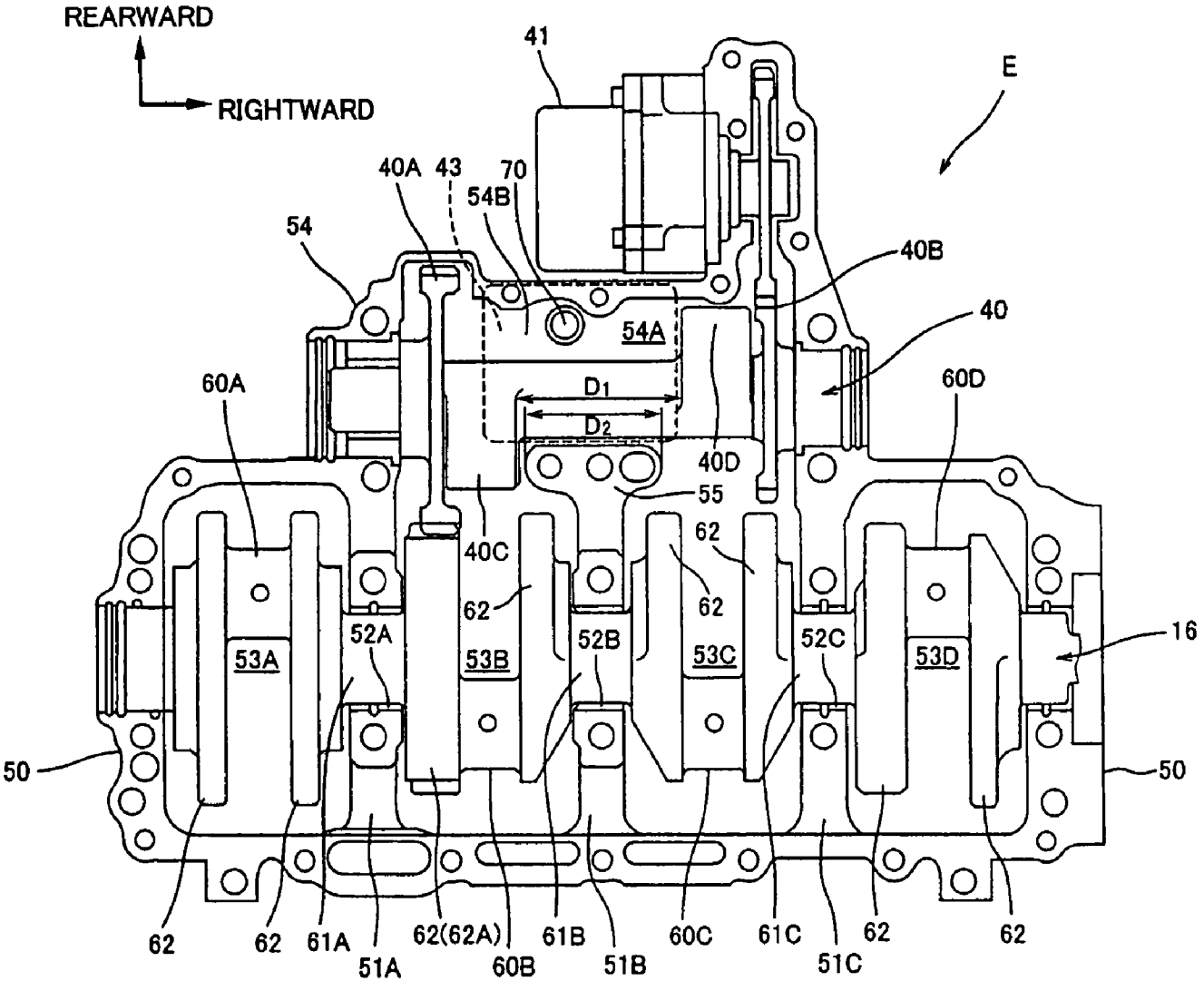
FIG. 4 is a bottom view of the crankcase of the engine, taken along line IV-IV of FIG. 2, showing an upper crankcase as viewed from below.

FIG. 3 is an enlarged partial cross-sectional view of the crankcase 31 shown in FIG. 2. FIG. 4 is a bottom view of the crankcase 31 of the engine, taken along line IV-IV of FIG. 2 along the plane (parting plane) 42, showing the upper crankcase 31A is seen from below. As shown in FIGS. 3 and 4, the crankshaft 16 is disposed at a front side in the interior of the crankcase 31 in such a manner that both end portions are rotatably mounted by right and left regions of an outer wall portion 50 of the crankcase 31. The crankshaft 16 includes four crank pins 60A to 60D arranged in this order from the left, three crank journals 61A to 61C each disposed adjacent crank pins, and crank webs 62 provided at both ends of the crank pins 60A to 60D, so as to correspond to the in-line four cylinders.

As shown in FIG. 4, mounting wall portions 51A to 51C are formed in the interior of the crankcase 31 to respectively correspond to the four cylinders. The mounting wall portions 51A to 51C are integral with the outer wall portion 50 and extend in a forward and rearward direction as viewed from bottom. The bearing portions 52A to 52C are mounted on the mounting portions 51A to 51C. The crank journals 61A to 61C are rotatably mounted by the bearing portions 52A to 52C, respectively. The left mounting wall portion 51A and the right mounting wall portion 51C are connected at their front and rear end portions to the outer side wall portion 50 to form closed inner spaces 53A and 53D, respectively that accommodate the crank pins 60A and 60D of the crankshaft 16.

A protruding portion 54 is formed at a rear region of the outer wall portion 50 of the crankcase 31 so as to protrude rearward from the left side wall portion 51A and the right side wall portion 51C. The balancer shaft 40 is accommodated in an inner space 54A formed within the protruding portion 54. As shown in FIGS. 3 and 4, the balancer shaft 40 is disposed to extend substantially in parallel with the crankshaft 16 and is rotatably mounted at both end portions thereof at right and left regions of the protruding portion 54 of the crankcase 31. The inner space 54A of the protruding portion 54 is connected to a left inner space 53B and a right inner space 53C which are located between the left mounting portion 51A and the right mounting portion 51C and separated from each other by a mounting wall portion 51B located at the center.

The crank web 62 that is in close proximity to the mounting wall portion 51A, of the two crank webs 62 located in the inner space 53B of the crankcase 31, has teeth on its outer peripheral portion to form an output gear 62A. The output gear 62A is meshed with an input gear 40A mounted on a left end portion of the balancer shaft 40. An output gear 40B is mounted on a right end portion of the balancer shaft 40 to drive the generator 41. Therefore, the rotational force of the crankshaft 16 is transmitted to the balancer shaft 40 through the output gear 62A and the input gear 40A, and further to the generator 41 through the output gear 40B of the balancer shaft 40.

Two balancer weights 40C and 40D are mounted between the left input gear 40A and the right output gear 40B of the balancer shaft 40 to be spaced a predetermined distance D1 from each other. A rear end portion (end portion on the balancer shaft 40 side) of the mounting wall portion 51B at the center in the interior of the crankcase 31 has a width D2 that is substantially equal to the distance D1 between the left balancer weight 40C and the right balancer weight 40D but is slightly smaller than the distance D1, thus forming a block portion 55. Therefore, the inner space 53B that is located at the left side closer to the center of the crankcase 31 and the inner space 54A formed by the protruding portion 54 are connected to each other through a gap formed between the left mounting wall portion 51A and the block portion 55 located at the center. In this gap, the input gear 40A and the left balancer weight 40C which are mounted on the balancer shaft 40 are located. Likewise, the inner space 53C that is located at the right side closer to the center of the crankcase 31, and the inner space 54A formed by the protruding portion 54, are connected to each other through a gap formed between the right mounting wall portion 51C and the block portion 55 located at the center. In this gap, the output gear 40B for the generator 41 and the right balancer weight 40D which are mounted on the balancer shaft 40 are located.

As shown in FIG. 3, a gas exhaust outlet 70 is formed to penetrate an upper side wall portion 54B of the protruding portion 54 of the crankcase 31 and is connected to the gas-liquid separating chamber 43B of the breather 43. As shown in FIG. 4, the gas exhaust outlet 70 is disposed above between the left balancer weight 40C and the right balancer weight 40D. As described in detail later, the gas exhaust outlet 70 has a peculiar structure in relation to the balancer shaft 40 located closest.

Figure 5:
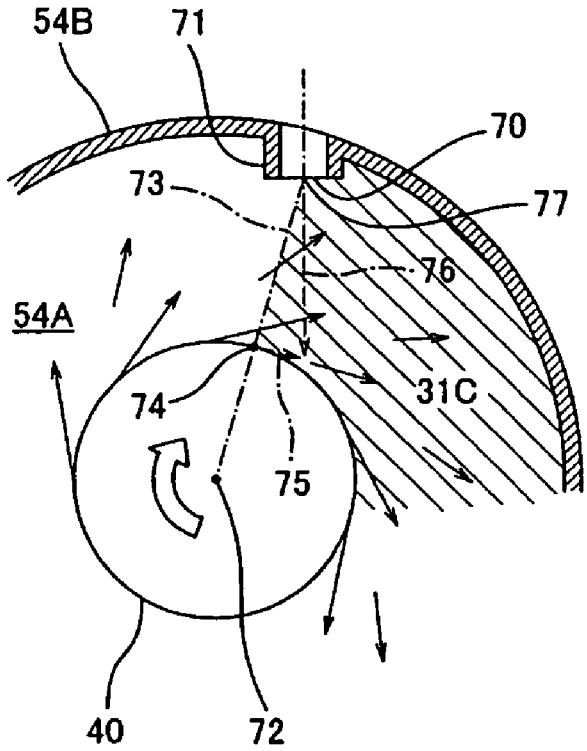
FIG. 5 is a schematic view showing a structure of a gas exhaust outlet.

FIG. 5 is a view schematically showing the unique structure of the gas exhaust outlet 70, in relation to the balancer shaft 40 located closest. As shown in FIG. 5, the gas exhaust outlet 70 is formed at a lower end portion of a gas exhaust pipe 71 extending from the upper side wall portion 54B of the crankcase 31 into the inner space 54A. The gas exhaust outlet 70 is formed so that an opening direction 76 is toward a region 31C (indicated by hatching in FIG. 5) in the interior of the crankcase 31, which extends from a line segment 73 connecting the gas exhaust outlet 70 to a rotational center axis 72 of the balancer shaft 40, in a rotational direction 75 of the balancer shaft 40 at a cross point 74 where the line segment 73 crosses an outer peripheral surface of the balancer shaft 40. As used herein, a start point of the line segment 73 extending from the gas exhaust outlet 70 is defined as a center position 77 of an opening plane of the gas exhaust outlet 70. The opening direction 76 of the gas exhaust outlet 70 conforms to a direction in which the blow-by gas flows through the center point 77 at the gas exhaust outlet 70.

The structure of the gas exhaust outlet 70 will be described in greater detail. As shown in FIG. 5, when the balancer shaft 40 rotates clockwise around the rotational center axis 72 of the balancer shaft 40, the gas exhaust outlet 70 located thereabove opens toward a rightward region relative to the line segment 73. Conversely, when the balancer shaft 40 rotates counterclockwise, the gas exhaust outlet 70 located thereabove opens toward a leftward region relative to the line segment 73.

As shown in FIG. 5, when the balancer shaft 40 rotates clockwise, the oil adhering onto the outer peripheral surface of the balancer shaft 40 scatters in the rotational direction of the balancer shaft 40 along a tangential direction of the outer peripheral surface thereof. Therefore, in the gas exhaust outlet 70 structured above, because an angle formed between the direction in which the oil scatters toward the gas exhaust outlet 70 and the opening direction of the gas exhaust outlet 70 is relatively large, it is possible to effectively suppress the entry of the oil into the gas exhaust outlet 70.

Figure 6:
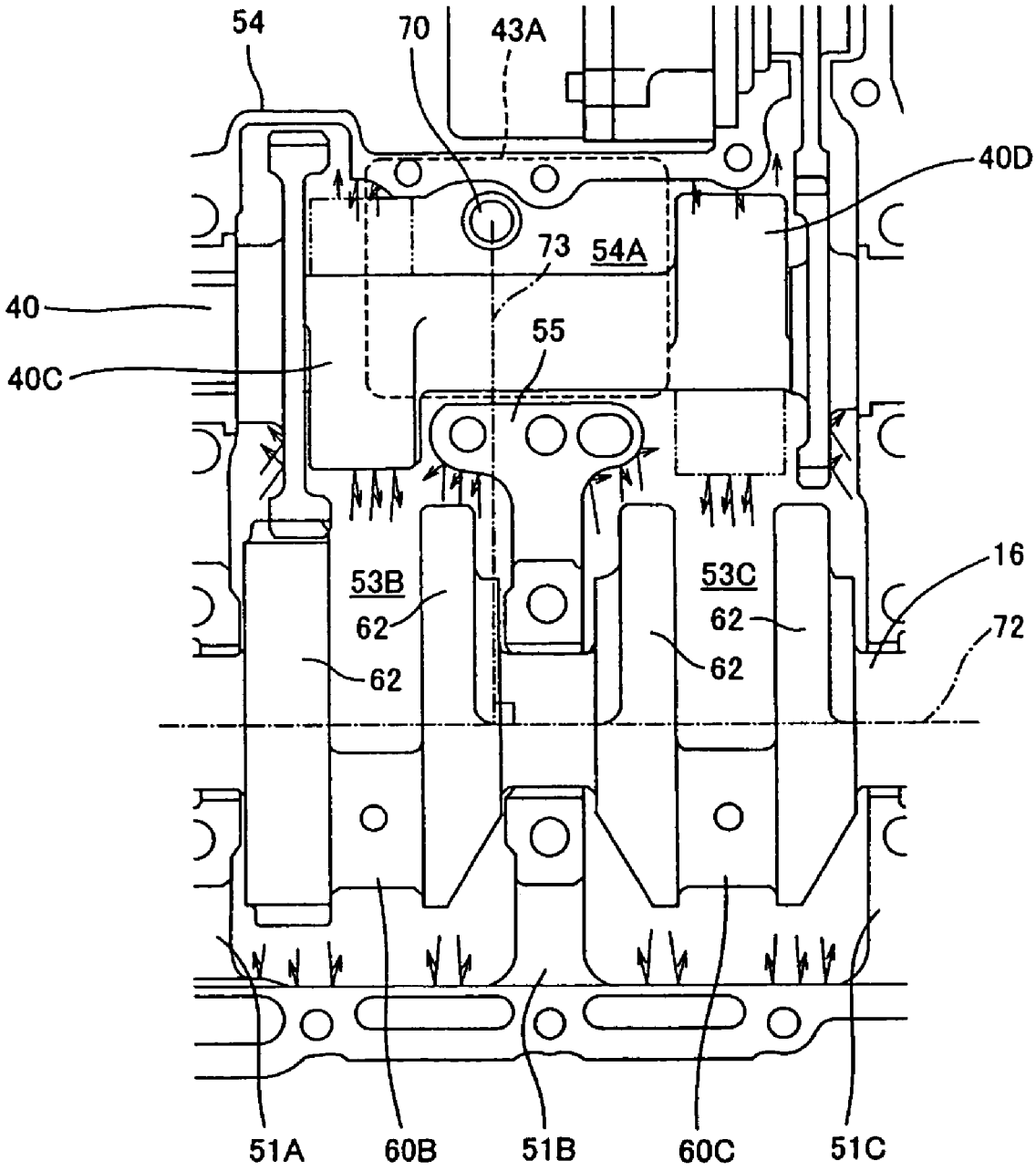
FIG. 6 is an enlarged view of a part of the engine of FIG. 4, showing a relationship among the gas exhaust outlet, a block portion, and a crankshaft.

As described above, in the engine E of this embodiment, the mounting wall portion 51B mounting the crank journal 61B at the center of the crankshaft 16 has the block portion 55 (see FIGS. 4 and 6) at the rear end portion thereof which is in close proximity to the gas exhaust outlet 70. As shown in FIG. 6, the block portion 55 crosses the line segment 73 connecting the gas exhaust outlet 70 to the rotational center axis 72 of the crankshaft 16 and perpendicular to the rotational center axis 72 of the crankshaft 16. Therefore, the oil adhering onto the crankshaft 16 and scattering along with its rotation is blocked by the block portion 55 and does not substantially enter the inner space 54A located behind, thereby suppressing the entry of the oil into the gas exhaust outlet 70 located in the inner space 54A. In FIG. 6, arrows indicate how the oil scatters.

Since in the interior of the crankcase 31, the input gear 40A, the output gear 40B, and the balancer weights 40C and 40D of the balancer shaft 40 are mounted in the gaps formed between the inner space 54A in which the gas exhaust outlet 70 exists and the inner spaces 53B and 53C located forward of the inner space 54A, the oil does not substantially flow from the forward inner spaces 53B and 53C into the rearward inner space 54A through the gaps, thus effectively suppressing the entry of the oil into the gas exhaust outlet 70.

In this embodiment, since the gas exhaust outlet 70 is directly connected to the gas-liquid separating chamber 43B within the breather 43, it is not necessary to externally attach pipe or the like to the crankcase 31. Thus, since the breather 43 is mounted on the upper side wall portion 54B of the crankcase 31, the gas exhaust outlet 70 and the breather 43 are connected to each other in a simplified manner. In addition, since the breather 43 is mounted at an upper region of the crankcase 31, a dimension in the rightward and leftward direction of the crankcase 31 does not become large. Thus, the engine E is suitably mounted in the motorcycle 1.

Some oil is separated from the blow-by gas in the gas-liquid separating chamber 43B within the breather 43 and is returned from the breather 43 to the crankcase 31 through a return hole (not shown). The blow-by gas from which the oil has been separated is mixed into the air through a passage (not shown) and is combusted again in the engine E.

Numerous modifications and alternative embodiments of the invention will be apparent to those skilled in the art in view of the foregoing description. Accordingly, the description is to be construed as illustrative only, and is provided for the purpose of teaching those killed in the art the best mode of carrying out the invention. The details of the structure and/or function may be varied substantially without departing from the spirit of the invention and all modifications which come within the scope of the appended claims are reserved.

What is claimed is:

1. A four-cycle engine comprising:

a gas exhaust outlet that is formed on an upper region of a crankcase and is configured to open toward an interior of the crankcase so as to exhaust a gas from an interior of the crankcase to outside; and a rotatable shaft disposed in close proximity to the gas exhaust outlet in the interior of the crankcase;

wherein the gas exhaust outlet is formed so that an opening direction which conforms to a direction in which the gas flows through a center point at the gas exhaust outlet is toward a region in the interior of the crankcase, the region extending from a line segment connecting the gas exhaust outlet to a rotational center axis of the shaft, in a rotational direction of the shaft at a cross point where the line segment crosses an outer peripheral surface of the shaft.

2. The four-cycle engine according to claim 1, wherein the shaft is a balancer shaft configured to support a balancer weight, and the gas exhaust outlet is disposed above the balancer shaft.

3. The four-cycle engine according to claim 1, wherein the crankcase has a mounting portion configured to rotatably mount the crankshaft, and the mounting portion has a block portion formed to cross a line segment connecting the gas exhaust outlet to a rotational center axis of the crankshaft and perpendicular to the rotational center axis of the crankshaft.

4. The four-cycle engine according to claim 1, further comprising:

a gas-liquid separating chamber mounted at the upper region of the crankcase to allow the gas from the gas exhaust outlet to flow thereinto.

5. A motorcycle comprising a four-cycle engine, the engine including:

a gas exhaust outlet that is formed on an upper region of a crankcase and is configured to open toward an interior of the crankcase so as to exhaust a gas from an interior of the crankcase to outside; and a rotatable shaft disposed in close proximity to the gas exhaust outlet in the interior of the crankcase;

wherein the gas exhaust outlet is formed so that an opening direction which conforms to a direction in which the gas flows through a center point at the gas exhaust outlet is toward a region in the interior of the crankcase, the region extending from a line segment connecting the gas exhaust outlet to a rotational center axis of the shaft, in a rotational direction of the shaft at a cross point where the line segment crosses an outer peripheral surface of the shaft.

6. The four-cycle engine according to claim 1, wherein as viewed along a center axis of the rotatable shaft, the gas exhaust outlet opens toward a rightward region relative to the line segment when the rotatable shaft rotates clockwise, while the gas exhaust outlet opens toward a leftward region relative to the line segment when the rotatable shaft rotates counter-clockwise.

* * * * *